US005647426A

United States Patent [19]

Prieto et al.

[11] Patent Number: 5,647,426

[45] Date of Patent: Jul. 15, 1997

[54] METHOD AND APPARATUS FOR CONTROLLED DIRECTIONAL SOLIDIFICATION OF A WHEEL CASTING

[75] Inventors: Romulo A. Prieto, Northville; Daniel C. Wei; Bor-Liang Chen, both of Ann Arbor, all of Mich.

[73] Assignee: Hayes Wheels International, Inc., Romulus, Mich.

[21] Appl. No.: 486,662

[22] Filed: Jun. 7, 1995

Related U.S. Application Data

[63] Continuation-in-part of Ser. No. 133,476, Oct. 7, 1993, abandoned.

[51] Int. Cl.[6] ..... B22D 27/04

[52] U.S. Cl. ..... 164/348; 164/312; 164/122.1

[58] Field of Search ..... 164/122, 122.1, 164/122.2, 125, 126, 128, 348, 458, 4.1, 312, 113

[56] References Cited

FOREIGN PATENT DOCUMENTS 2-41761 2/1990 Japan ..... 164/348

2196281 4/1988 United Kingdom ..... 164/122.1

*Primary Examiner*—Kuang Y. Lin

*Attorney, Agent, or Firm*—MacMillan, Sobanski & Todd

[57] ABSTRACT

A multi-piece wheel mold defining a mold cavity having a wheel rim cavity and a wheel disc cavity includes a large mass of metal adjacent to the outboard end of the wheel rim cavity and a small mass of metal adjacent to the inboard end of the wheel rim cavity. The mold also includes tapered side segments having a portion adjacent to the inboard end of the wheel rim cavity which is formed from a metal having a first conductivity of heat transfer. The side segments further have a second portion adjacent to the outboard end of the wheel rim cavity which is formed from a second metal having a second conductivity of heat transfer which is greater than the conductivity of heat transfer of the first portion. Molten metal in the mold cavity initially begins to solidify in the outboard end of the wheel rim cavity. Solidification of the molten metal then proceeds simultaneously in an axial direction across the wheel rim cavity towards the inboard end of the wheel rim and in a radial direction across the wheel disc cavity towards the center of wheel disc.

17 Claims, 11 Drawing Sheets

METHOD AND APPARATUS FOR CONTROLLED DIRECTIONAL SOLIDIFICATION OF A WHEEL CASTING

CROSS REFERENCE TO RELATED APPLICATION

This application is a continuation-in-part of U.S. patent application Ser. No. 8/133,476 filed Oct. 7, 1993, now abandoned.

BACKGROUND OF THE INVENTION

This invention relates in general to cast vehicle wheels and in particular to a method and an apparatus for casting such wheels.

Cast wheels formed from light weight metal alloys are replacing steel wheels on an increasing number of vehicles. Such cast wheels provide both a reduction in weight from steel wheels and an attractive appearance. Cast wheels are cast by pouring a molten metal, typically an alloy of a light weight metal, such as aluminum, magnesium or titanium, into a wheel mold assembly to form a wheel casting.

Referring to the drawings, there is shown in FIG. 1 a sectional view of a typical wheel casting, indicated generally at 10, formed in accordance with the prior art. For clarity, section lines have been omitted from FIG. 1. Additionally, in the following discussion of the wheel casting, "inner" refers to a portion of the wheel oriented towards a vehicle (not shown) when the wheel is mounted thereon while "outer" refers to a portion of the wheel oriented away from the vehicle.

The wheel casting 10 includes a relatively thin annular rim portion 11 which carries a vehicle tire (not shown). The rim portion 11 has a recessed center well 12 formed between inner and outer bead seats 13 and 14. An inner flange 15 is formed on the inner edge of the inner bead seat 13 and extends radially outward. An annular rim riser 16 extends axially upward in FIG. 1 from the inner flange 15. An outer flange 17 is formed on the outer edge of the outer bead seat 14 and extends radially outward. The flanges 15 and 17 function to retain a vehicle tire upon the finished wheel.

A wheel disc 18 extends across the outer end of the casting 10. The junction of the wheel disc 18 to the rim portion 11 forms a sidewall 14A which is accordingly thicker than either the wheel disc 18 or the rim portion 11. The wheel disc 18 typically includes a plurality of openings (not shown) formed therethrough which allow a flow of cooling air to the vehicle brakes while reducing the wheel weight. A wheel hub 19 is formed in the center of the wheel disc 18. The hub 19 includes a central aperture which receives an axle end (not shown) and a plurality of bolt holes (not shown) for attaching the finished wheel to a vehicle. A generally cylindrical hub riser 20 extends upward in FIG. 1 from the inner end of the wheel hub 19.

Once the wheel casting 10 has cooled sufficiently, it is removed from the mold and machined to final shape. The wheel also can be subjected to solution heat treatment and aging. The outer surface of the wheel disc is often highly polished and can include decorative painted portions.

The manner in which the molten metal forming the wheel casting 10 cools and the structure of the mold in which the wheel is cast affect the physical characteristics of the wheel. For the following discussion, portions of the wheel section shown in FIG. 1 are labeled with letters. The portion of the wheel 10 included in the inner flange 15 is labeled with the letter "A" and the narrowest section of the center well 12 is labeled with the letter "B". Similarly, the sidewall 14A is labeled with the letter "C" and the narrowest section of the wheel disc 18 is labeled with the letter "D". The wheel hub 19 is labeled with the letter "E".

The molten metal forming the wheel casting 10 solidifies first in the thinnest portions of the casting, since these portions cool the fastest. Thus, solidification of the molten metal typically begins in the shaded portions of the center well 12 and wheel disc 18 shown in FIG. 1 and labeled B and D. The solidification then proceeds towards the thicker portions of the wheel casting 10 as illustrated with small direction arrows on FIG. 1. As shown in FIG. 1, the solidification proceeds in two axial directions simultaneously through the rim portion 11, from B inwardly towards A, and from B outwardly towards C. Similarly, the solidification of the wheel disc 18 proceeds in two radial directions simultaneously from D outwardly towards C and inwardly towards E. Finally, solidification begins at the outboard flange 17 and proceeds towards C.

The cooling rate and thereby the solidification of the molten metal can be further affected by the particular mold geometry to the extent that it is not possible to identify solidification directions.

As the molten metal solidifies, a crystalline structure consisting of individual metal grains is formed in the wheel casting 10. The individual grains vary in size within the casting 10. Generally, the portion of the casting 10 that solidifies first has a smaller grain size and the grain size increases proportionally with the length of time required for cooling. The average grain size for the prior art wheel casting 10 as a function of position within the casting 10 is graphically illustrated in FIG. 2 by the line 30. The letters shown along the horizontal axis in FIG. 2 correspond to the letter labels shown in FIG. 1 and indicate the relative position on the wheel casting 10. For the typical wheel casting 10 illustrated in FIG. 2, the grain sizes vary over a wide range, from 44 to 106 microns (um). The minimum grain size illustrated in FIG. 2 corresponds to the portions B and D of the wheel casting 10 which solidify first. The larger grain sizes indicated for portions A and E, which solidify last, result in an increased porosity in these portions of the wheel casting 10. Large grain size causes a low structural casting strength and the high porosity can allow escape of the pressurized air contained in a tire mounted upon the finished wheel. The irregular shape of the line 30 indicates that solidification occurred in multiple directions in the rim portion 11 and the wheel disc 18.

The crystalline structure of the wheel casting 10 is related to the mold used to cast the wheel. Cast wheels are typically formed by gravity feeding or pressure injecting molten metal into a mold cavity formed in a multi-piece steel wheel mold assembly. A simplified sectional view of a prior art multi-piece mold assembly 40 for casting the wheel casting 10 is shown in FIG. 3. The individual pieces of the mold assembly 40 are typically formed from cast iron or high carbon steel. The mold assembly 40 includes a base member 41 which supports the other pieces of the mold assembly 40. Two or more retractable side members 42A and 42B are carried by the base member 41. A removable cup-shaped top member 43 having a cylindrical center portion 43A is disposed within the mold side members 42A and 42B.

The mold members 41, 42A, 42B and 43, upon assembly, define a main mold cavity 44 wherein the wheel casting 10 is cast. The main cavity 44 includes an annular rim cavity 45 for casting the wheel rim portion 11 and a disc cavity 46 for casting the wheel disc 18. An annular sidewall cavity 47 for casting the wheel sidewall 14A joins the rim cavity 45 to the disc cavity 46. The base member 41 defines the outer surface 46A of the disc cavity 46. Similarly, the side members 42A and 42B define outer surfaces 45A and 47A of the rim and sidewall cavities 45 and 47. The top member 43 defines inner surfaces 45B and 47B of the rim and sidewall cavities 45 and 47 and an inner surface 46B of the disc cavity 46. The side members 42A and 42B and the top member 43 further define an annular rim riser cavity 48 formed adjacent to the rim cavity 45. Similarly, a cylindrical hub riser cavity 49 is formed in the top member center portion 43A adjacent to the inner center of the disc cavity 46.

To cast a wheel casting 10, molten metal is fed by a conventional method, such as gravity or under pressure, into the main cavity 44 through a sprue (not shown). The molten metal flows into the disc, sidewall and rim cavities 46, 47 and 45, and then fills the rim and hub riser cavities 48 and 49. Molten metal flows from the riser cavities 48 and 49 into the main cavity 44 to fill any voids formed as the metal in the main cavity 44 cools and contracts.

To facilitate the flow of molten metal contained in the riser cavities 48 and 49 into the main cavity 44 as needed, the rim and disc cavities 45 and 46 are purposely made wide. The wide rim and disc cavities 45 and 46 join to form a wide sidewall cavity 47. Thus, the resulting wheel casting 10 has a relatively thick rim portion 11, sidewall 14A and wheel disc 18. The thick rim portion 11 and wheel disc 18 require a long cooling time for the molten metal forming them to solidify. Accordingly, the riser cavities 48 and 49 are made large to hold sufficient metal to assure that a portion of the metal within the risers remains molten until needed.

SUMMARY OF THE INVENTION

This invention relates to an improved wheel mold for controlling the cooling of molten metal forming a wheel casting such that solidification occurs in a predetermined manner within the mold.

As described above, the molten metal solidifies first in the shaded areas B and D of the prior art mold assembly 40, as shown in FIG. 1. This blocks the flow of molten metal from the rim and hub risers 48 and 49 to the outer portions of the rim portion 11 and wheel disc 18 and the side wall 14A. Thus, the resulting shrinkage of the metal in these portions cannot be replaced with molten metal from the riser cavities 48 and 49. This unreplenished metal shrinkage can result in formation of voids in the resulting wheel casting. Such voids weaken the finished wheel and potentially mar the wheel appearance.

The long cooling time necessitated by the wide mold cavities and thick castings results in formation of relatively large sized grains in the crystalline structure of the castings, as illustrated in FIG. 2. As described above, large grain structure produces a low structural strength and high porosity in the casting. High porosity of the wheel rim 11 can allow escape of the pressurized air contained in a tire mounted upon the finished wheel. The thick rim portion 11 and wheel disc 18 compensate for this greater porosity of the casting 10. To provide sufficient wheel strength and maintain tire pressure, the thick rim portion and wheel disc are retained when the casting 10 is machined to final shape. However, this results in a relatively heavy finished wheel and requires more material to cast each wheel. Thus, it is desirable to provide an improved wheel mold having narrower rim and disc cavities and which provides faster and controlled directional cooling of the molten metal.

The present invention contemplates a mold for casting a vehicle wheel having a base member which supports a plurality of arcuate-shaped side members. A top member is disposed within the side members and cooperates with the side and base members to define a wheel mold cavity. The wheel mold cavity includes a rim portion for casting a wheel rim and a disc portion for casting a wheel disc. At least one of the side and top members includes a tapered wall portion. The molten metal contained in the mold cavity adjacent to the wider portion of the tapered wall solidifies before molten metal contained in the mold cavity adjacent to the narrower portion of the wall portion. In the preferred embodiment of the invention, the wider portion of the wall portion is adjacent to the portion of the mold cavity which forms the wheel side wall. Thus, the molten metal forming the sidewall solidifies first. Solidification then proceeds simultaneously in an axial direction across the rim portion of the mold cavity and radially across the disc portion of the mold cavity.

The invention further contemplates the mold having a relatively large mass of metal adjacent to the wider portion of the tapered wall portion and a relatively small mass of metal adjacent to the narrower portion of the wall portion. The masses of metal conduct heat from the mold at different rates, with the large mass of metal conducting more heat than the small mass of metal. This enhances the directional cooling of the molten metal within the mold cavity.

The cooling of the molten metal can be further controlled by forming a portion of the inboard end of the wheel mold from a material having a lower coefficient of thermal conductivity than the material forming the outboard end of the wheel mold.

The invention also contemplates providing a supplemental cooling apparatus which is mounted within the top member. The cooling apparatus provides a temperature gradient which extends axially across the inner surface of the top member. The cooling apparatus includes a wall which is mounted parallel to the inner surface of the top member and spaced apart therefrom. A cooling medium is supplied to the inboard end of the cooling apparatus and flows across the inner surface of the top member before being discharged form the cooling apparatus. As heat is removed form the top member, the cooling member is heated and removes less heat. Accordingly, a temperature gradient is established across the top member.

The improved wheel mold cools the molten metal forming the wheel casting more rapidly than prior art wheel molds. The reduced cooling time results in an improved wheel casing having a finer grain size, increased strength and reduced porosity than a comparable prior art wheel casting. The increased strength and reduced porosity allow production of a thinner rim portion and wheel disc, reducing wheel weight and the amount of material required to form a wheel. Finer grain size also generally corresponds to faster cooling. Faster cooling allows a higher wheel production rate for a fixed number of wheel molds.

Other advantages of this invention will become apparent to those skilled in the art from the following detailed description of the preferred embodiment, when read in light of the accompanying drawings.

DETAILED DESCRIPTION OF THE PREFERRED EMBODIMENT

Figure 4:
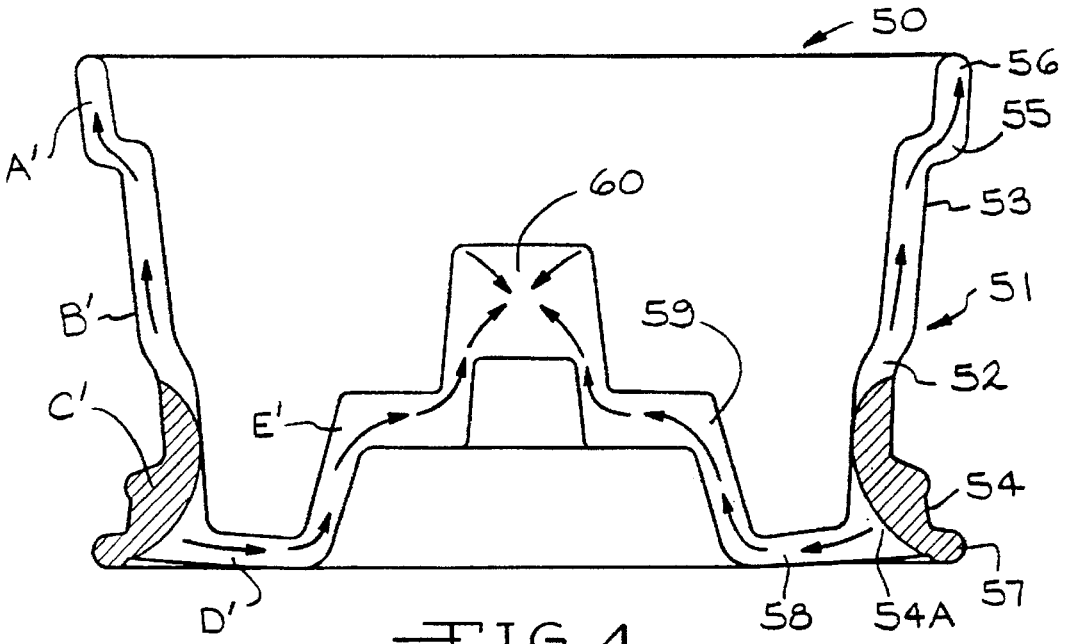
FIG. 4 is a sectional view of a wheel casting formed in accordance with the present invention.

Referring again to the drawings, there is shown in FIG. 4 a sectional view of an improved wheel casting, indicated generally at 50, formed in accordance with the present invention. For clarity, section lines have been omitted from FIG. 4. As in the above, in the following discussion of the wheel casting, "inner" refers to a portion of the wheel oriented towards a vehicle (not shown) when the wheel is mounted thereon while "outer" refers to a portion of the wheel oriented away from the vehicle.

While FIG. 4 shows a one piece wheel casting 50, the invention can be practiced upon only a cast component of a multi-piece wheel such as, for example, a center spider portion (not shown), which is then secured to a separately formed rim (not shown) in a know manner to form a finished wheel. As will be described below, the cast component can also be the full front face of a wheel which is subsequently secured to a formed partial wheel rim. Thus, as used in this description and the following claims, the term "wheel casting" includes not only a one piece wheel casting, but also a component casting of a multi-piece wheel.

Figure 1:
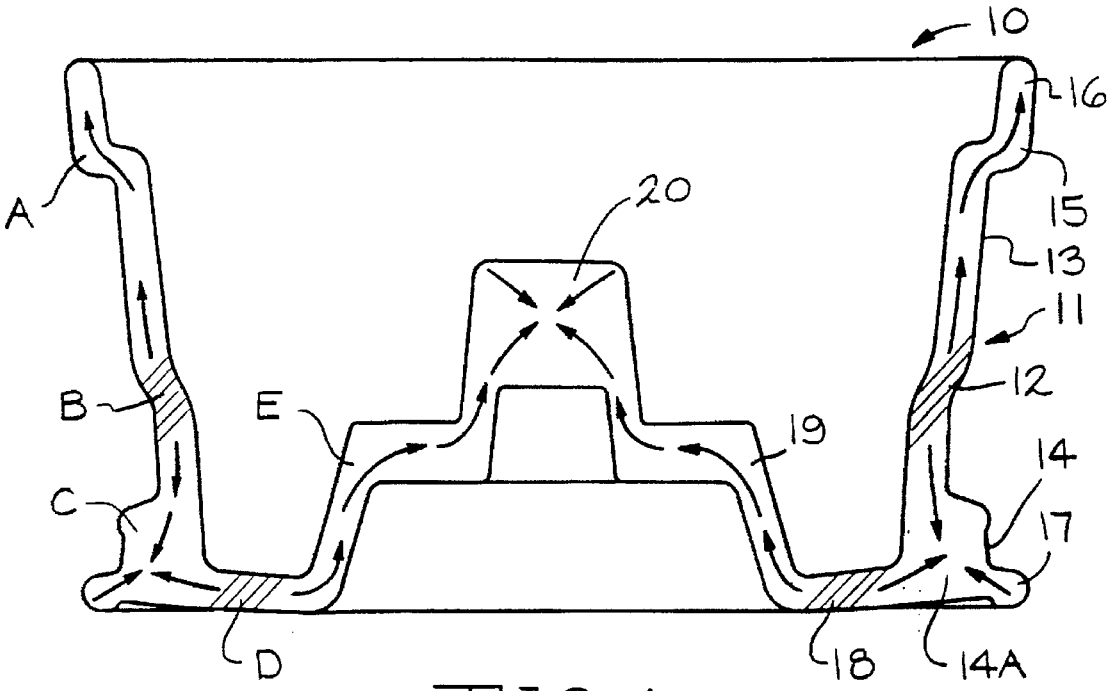
FIG. 1 (PRIOR ART)
FIG. 1 is a sectional view of a wheel casting formed in accordance with the prior art.

The improved casting 50 has the same general shape as the prior art casting 10 described above and is intended for use as a replacement therefor. Similar to the prior art casting 10 shown in FIG. 1, the improved casting 50 includes an annular rim portion 51. The rim portion 51 has a recessed center well 52 formed between inner and outer bead seats 53 and 54. An inner flange 55 is formed on the inner edge of the inner bead seat 53 and extends radially outward. An annular rim riser 56 extends axially upward in FIG. 4 from the inner flange 55. An outer flange 57 is formed on the outer edge of the outer bead seat 54 and extends radially outward. A wheel disc 58 extends across the outer end of the casting 50. The junction of the wheel disc 58 to the outer end of the rim portion 51 forms a thick sidewall 54A. A hub 59 is formed in the center of the wheel disc 58. A generally cylindrical hub riser 60 is provided on the inner end of the wheel hub 59.

As will be explained below, the rim portion 51 and the wheel disc 58 of the improved casting 50 are thinner than the corresponding portions of the prior art casting 10. Furthermore, the risers 56 and 60 are smaller than the prior art wheel risers 16 and 20.

For the following discussion, portions of the wheel section shown in FIG. 4 are also labeled with letters. Thus, the portion of the wheel 50 included in the inner flange 55 is labeled with the letter "A'" and the narrowest section of the center well portion 52 is labeled with the letter "B'". Similarly, the sidewall 54A is labeled with the letter "C'" and the narrowest section of the wheel disc 58 is labeled with the letter "D'". The wheel hub 59 is labeled with the letter "E'".

As will also be explained below, the direction of solidification of the molten metal forming the improved casting 50 is carefully controlled. Directional arrows in FIG. 4 indicate the direction for solidification of the molten metal forming the casting 50. The solidification begins in the shaded area in FIG. 4 which includes the outer flange 57, a portion of the sidewall 54A labeled C' and a portion of the center well 52 labeled B' adjacent to the sidewall 54A. The solidification then concurrently proceeds in two directions. One direction is axially across the wheel rim portion 51 towards A'. The second direction is radially inwardly across the wheel disc 58 towards E'. Thus, solidification of the improved casting 50 is controlled to proceed in particular direction within the rim and wheel disc portions 51 and 58 of the wheel casting 50.

Figure 2:
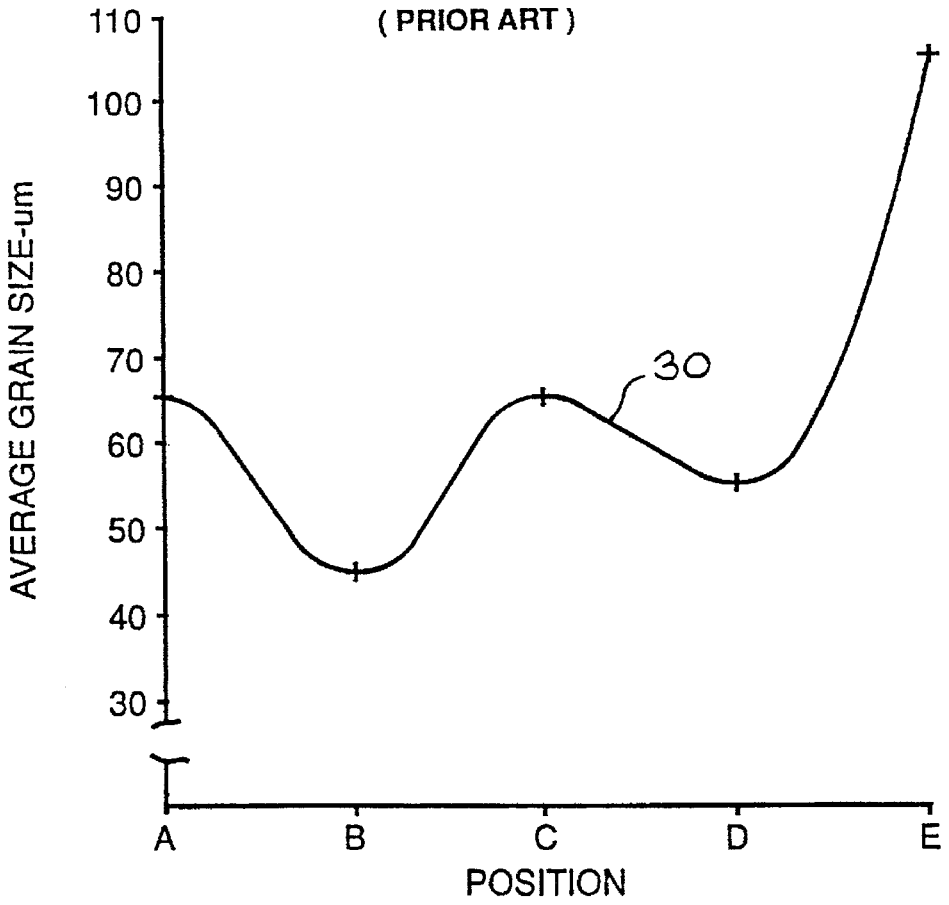
FIG. 2 (PRIOR ART)
FIG. 2 is a graph showing the average size of metal grains in the wheel casting shown in FIG. 1.
Figure 3:
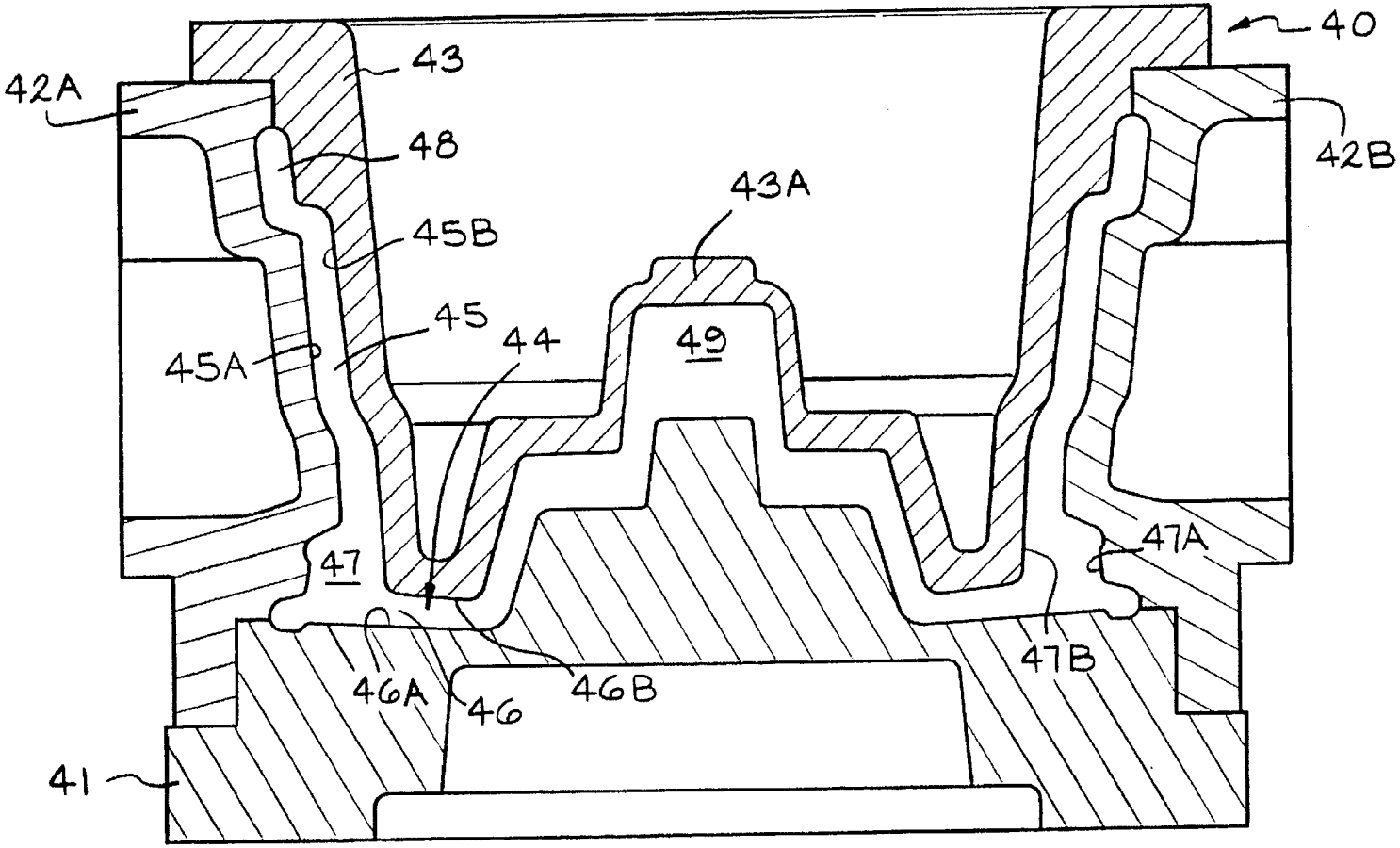
FIG. 3 (PRIOR ART)
FIG. 3 is a sectional view of a prior art mold assembly used to cast the wheel casting shown in FIG. 1.
Figure 5:
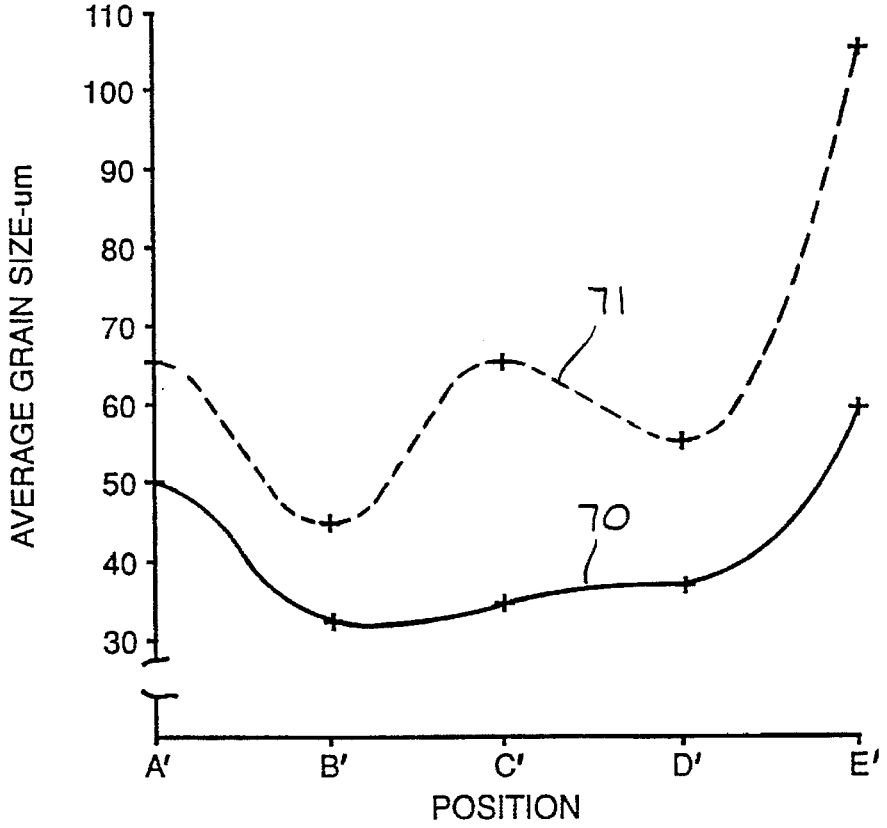
FIG. 5 is a graph comparing the average size of grains in the wheel casting shown in FIG. 4 to the average size of grains in the wheel casting shown in FIG. 1.

The improved wheel casting 50 is cooled more quickly than the prior art wheel casting 10. This causes the improved wheel casting 50 to have a finer grain structure than the prior art casting 10. This is illustrated in FIG. 5, where the grain size as a function of position within the improved casting 50 is shown with the solid line 70. For comparison, the average grain sizes for the prior art casting 10 shown in FIG. 2 are included in FIG. 5 with a dashed line 71. The improved casting 50 exhibits a finer grain structure than the prior art casting 10 throughout. For the typical wheel casting 50 illustrated in FIG. 4, the grain sizes vary over a narrow range from 28 um to 65 um. Compared to the prior art wheel casing 10, the average casting grain size in the improved casting 50 has been reduced by the present invention by approximately 38 percent. Furthermore, the grain size is relatively uniform for a large portion of the casting 50 extending from B' to D'.

Figure 6:
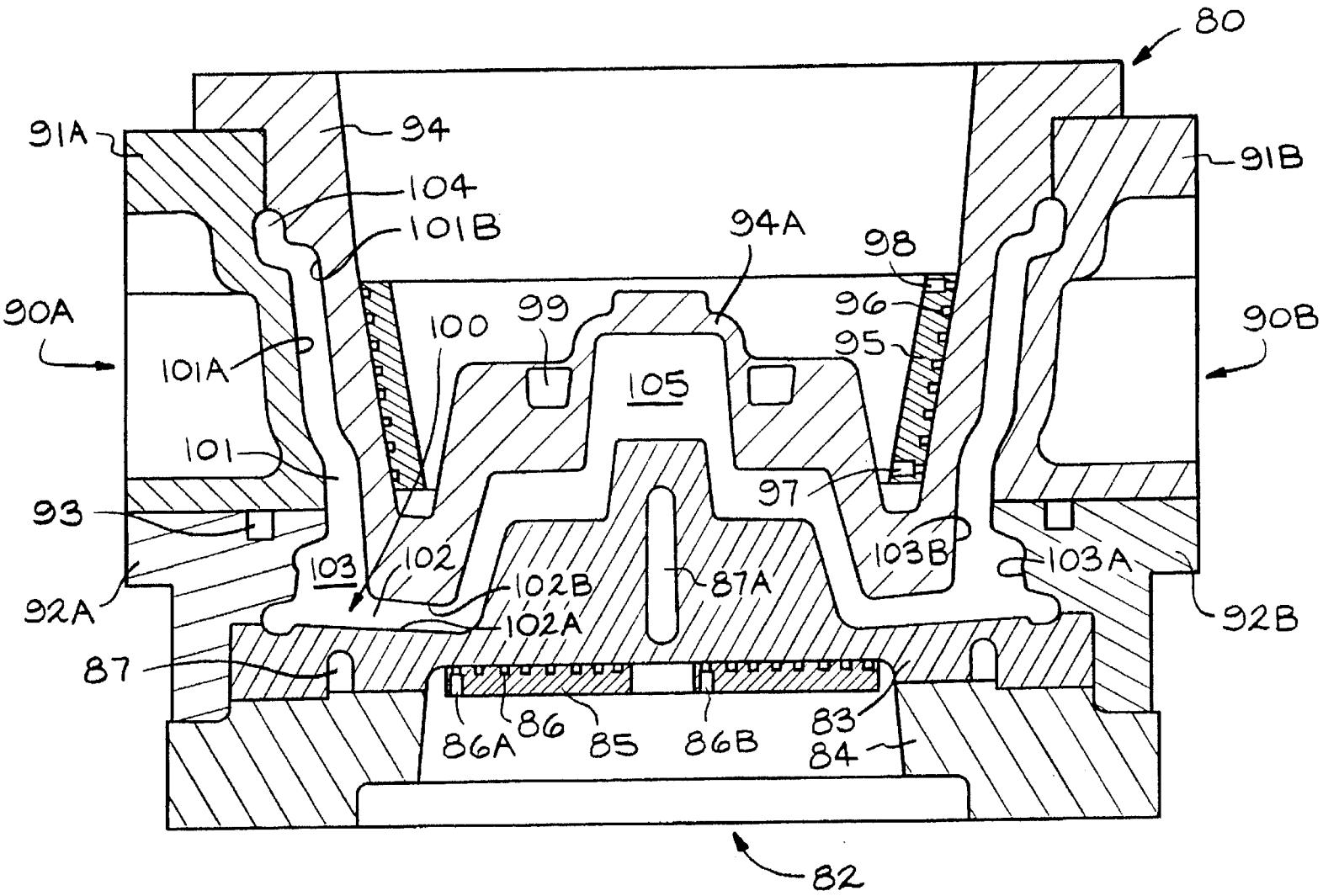
FIG. 6 is a sectional view of an improved mold assembly used to cast the wheel casting shown in FIG. 4.

A simplified sectional view of an improved multi-piece mold assembly 80 for casting the improved wheel casting 50 is shown in FIG. 6. As in the prior art mold assembly 40, the improved mold assembly 80 is formed from cast iron or high carbon steel. Similar to the prior art mold assembly 40, the improved mold assembly 80 includes a base member 82 which supports the other pieces of the mold assembly 80. The base member 82 has a generally disk-shaped upper portion 83 mounted upon a ring shaped lower portion 84. A disk-shaped base cooling block 85 formed of a metal having a high heat conductivity is attached to the bottom surface of the base member upper portion 83. The base cooling block 85 includes a spiral passageway 86 formed therein for conducting a cooling medium, as will be described below. The passageway 86 includes an inlet port 86A formed near the perimeter of the cooling block 85 and an outlet port 86B formed near the center of the block 85. The base upper portion 83 further includes a circumferential ring-shaped cooling passageway 87 formed therein adjacent to the base lower portion 84. The base upper portion 83 also includes an axial cooling passageway 87A formed therein extending into the center of the base member upper portion 83.

Two or more retractable side members 90A and 90B are carried by the base member 82. Similar to the base member 82, the side members 90A and 90B include upper portions 91A and 91B and lower portions 92A and 92B. A ring-shaped passageway 93 is formed in the lower side portions 92A and 92B adjacent to the upper side portions 91A and 91B. As will be described below, the passageway 93 is also located adjacent to the portion of the mold 80 which forms the casting sidewall 54A. The passageway 93 carries a cooling medium, as will be described below.

A removable cup-shaped top member 94 having a cylindrical center portion 94A is disposed within the side members 90A and 90B. An inner cooling block 95 having an inverted frustum shape is attached to the lower portion of the inner surface of the top member 94. The inner cooling block 95 is formed from a metal having a high heat conductivity and includes a passageway 96 formed therein for conducting a cooling medium. The passageway 96 can be formed in a spiral shape from the bottom to the top of the inner cooling block 95. An inlet port 97 formed near the bottom of the cooling block 95 receives a cooling medium and an outlet port 98 formed near the top of the cooling block 95 discharges the cooling medium.

As an alternate, the cooling passageway 96 can be formed as a plurality of parallel vertical passageways (not shown). The lower ends of the vertical passageways communicate with a ring-shaped inlet header (not shown) formed in the bottom of the cooling block 95. Similarly, the upper ends of the vertical passageways communicate with a ring-shaped outlet header (not shown) formed in the top of the cooling block 95. The use of the inner cooling block 95 will be described below.

The top member 94 further has a ring-shaped central cooling passageway 99 formed within the cylindrical center portion 94*a*.

The assembled mold members 82, 90A, 90B and 94 define a main mold cavity 100. Similar to the prior art mold 40, the main cavity 100 includes an annular rim cavity 101 for casting the wheel rim portion 51 and a disc cavity 102 for casting the wheel disc 58. An annular sidewall cavity 103 for casting the wheel sidewall 54A joins the rim cavity 101 to the disc cavity 102. As will be explained below, the rim, sidewall and disc cavities 101, 103 and 102 are narrower than the corresponding cavities in the prior art mold assembly 40. The base member 82 defines an outer surface 102A of the disc cavity 102. The side members 90A and 90B define outer surfaces 101A and 103A of the rim and sidewall cavities 101 and 103. The top member 94 defines inner surfaces 101B and 103B of the rim and sidewall cavities 101 and 103 and an inner surface 102B of the disc cavity 102. The upper side members 91A and 91B and the top member 94 further define an annular rim riser cavity 104 formed adjacent to the rim cavity 101. A cylindrical hub riser cavity 105 is formed in the cylindrical portion 94A of the top member 94 adjacent to the inner center of the disc cavity 102. As will be explained below, the improved mold assembly 80 has smaller rim riser and hub riser cavities 104 and 105 than the prior art mold assembly 40.

The operation of the improved mold assembly 80 to cast an improved wheel casting 50 will now be described. Molten metal is introduced into the main cavity 100 by conventional means, such as gravity feed or low pressure injection through a sprue (not shown). The molten metal fills the main cavity 100 and the riser cavities 104 and 105.

Forced cooling is applied to the mold assembly 80 by circulating a cooling medium through the side mold cooling passageway 93. Typical cooling mediums include air, a water and air mist and cooling water. However, other cooling mediums can be used. The above is applicable when a cooling medium is referenced in the following discussion.

The forced cooling rapidly cools the molten metal in the main mold cavity 100 adjacent to the passageway 93, which is in the vicinity of the outer bead seat 54 and sidewall 54A of the casting 50. This causes solidification of the molten metal forming the wheel casting 50 to begin in the vicinity of the sidewall 54A as shown by the shaded areas shown in FIG. 4. The solidification of the molten metal then continues concurrently in two directions, as illustrated with small direction arrows on FIG. 4. The solidification proceeds axially across the rim cavity 101 towards the inner flange 55. At the same time, solidification proceeds radially inwardly across the wheel disc cavity 102 towards the center of the wheel disc 58.

Additional forced cooling is applied to the rim cavity 101 by circulating a cooling medium through the cooling passageway 96 in the core inner cooling block 95. The cooling medium is injected into the inlet port 97 located at the bottom of the cooling block 95 and discharged from the outlet port 98 at the top of the cooling block 95. As the cooling medium passes from the inlet port 97 to the outlet port 98, the cooling medium temperature increases as heat is transferred from the molten metal. Thus, greater cooling occurs at the base of the side of the top member 94 with the cooling effect lessening in the direction of the top of the top member 94. This creates a temperature gradient axially across the inner surface 101B of the rim cavity 101, further controlling the solidification to occur thereacross in a particular direction. This additional forced cooling can be initiated at the same time as the forced cooling in the vicinity of the sidewall 54A or delayed in time relative thereto.

Forced cooling is applied to the base upper portion 83 by circulating a cooling medium through the mold base cooling passageways 87 and 87A and the spiral cooling passageway 86 in the mold base cooling block 85. As described above, the cooling medium is injected into the spiral passageway 86 near the perimeter of the cooling block 85 and removed from the passageway 86 near the center of the block 85. As the cooling medium passes through the spiral passageway 86, the cooling medium temperature increases as heat is transferred from the molten metal. Thus, greater cooling occurs at the perimeter of the cooling block 85 than at the center thereof. This creates a radial temperature gradient across the outer surface 102A of the disc cavity 102 that further controls the solidification of the molten metal forming the wheel disc 58 to occur in a particular direction.

The cooling medium can be applied to all the base cooling passageways 87, 86 and 87A simultaneously or sequentially. As with the top member 94, the forced cooling of the base upper portion 83 can be initiated at the same time as the forced cooling in the vicinity of the sidewall 54A or delayed relative thereto.

Cooling of the casting 50 is completed by circulating cooling medium through the hub riser cooling passageway 99 to solidify the metal in the hub riser cavity 105.

In the preferred embodiment, sequential application of the forced cooling has been successfully used. Such sequential application includes initiating the cooling on the exterior of the side members 90A and 90B, then, after a delay, cooling the inner surface of the top member 94. Following a further delay, cooling is applied to the base upper portion 83. Finally, cooling is applied to the cylindrical portion 94A of the top member 94.

As the rim portion 51 of the casting 50 solidifies in an axial direction from the sidewall 54A towards the inner flange 53, molten metal is withdrawn from the rim riser cavity 104 to compensate for metal contraction. However, with the improved mold assembly 80, the molten metal is not blocked by solidified metal, as described above for the prior art mold assembly 40. Similarly, as the wheel disc 58 solidifies in a radial direction from the sidewall 54A towards the hub 59, molten metal is withdrawn from the hub riser cavity 105 to compensate for metal contraction. Thus, the potential of forming voids in the portion indicated by C' is greatly reduced in the improved wheel casting 50.

As mentioned above, the rapid cooling significantly reduces the grain size in the crystalline structure of the casting 50. The finer grain size results in a stronger wheel casting 50 having less porosity than the prior art casting 10. Accordingly, the rim portion 51, the sidewall portion 54A and the wheel disc 58 of the improved casting 50 are cast thinner than the corresponding portions of the prior art casting 40. The resulting thinner wheel is lighter in weight than the prior art wheel and requires less material.

Accordingly, the rim, sidewall and disc cavities 101, 103 and 102 of the improved mold 80 are narrower than the corresponding cavities in the prior art mold 40. With narrower cavities, the molten metal in the improved mold 80 cools faster than in the prior art mold 40. Thus, the length of time during which the metal within the rim and hub riser cavities 104 and 105 must be maintained in a molten state is reduced. This allows reduction of the size of the rim and hub riser cavities 104 and 105 from the size of the corresponding riser cavities used in the prior art mold 40.

The reduced cooling time required for solidification of the metal within the improved mold 80 described above has substantially reduced the time required to cast a wheel. Typically, five to seven minutes are required to cast a wheel according to the prior art. With the present invention, casting time for an equivalent wheel is reduced to three to four minutes per wheel. Thus, the present invention significantly increases the rate of wheel production for a fixed number of molds. Additional savings in production time are achieved because less machining of the wheel casting 50 is required to finish the wheel.

Because of the lower porosity of the improved wheel casting 50, the thinner rim portion 51 does not leak air from the tire mounted thereupon.

Figure 7:
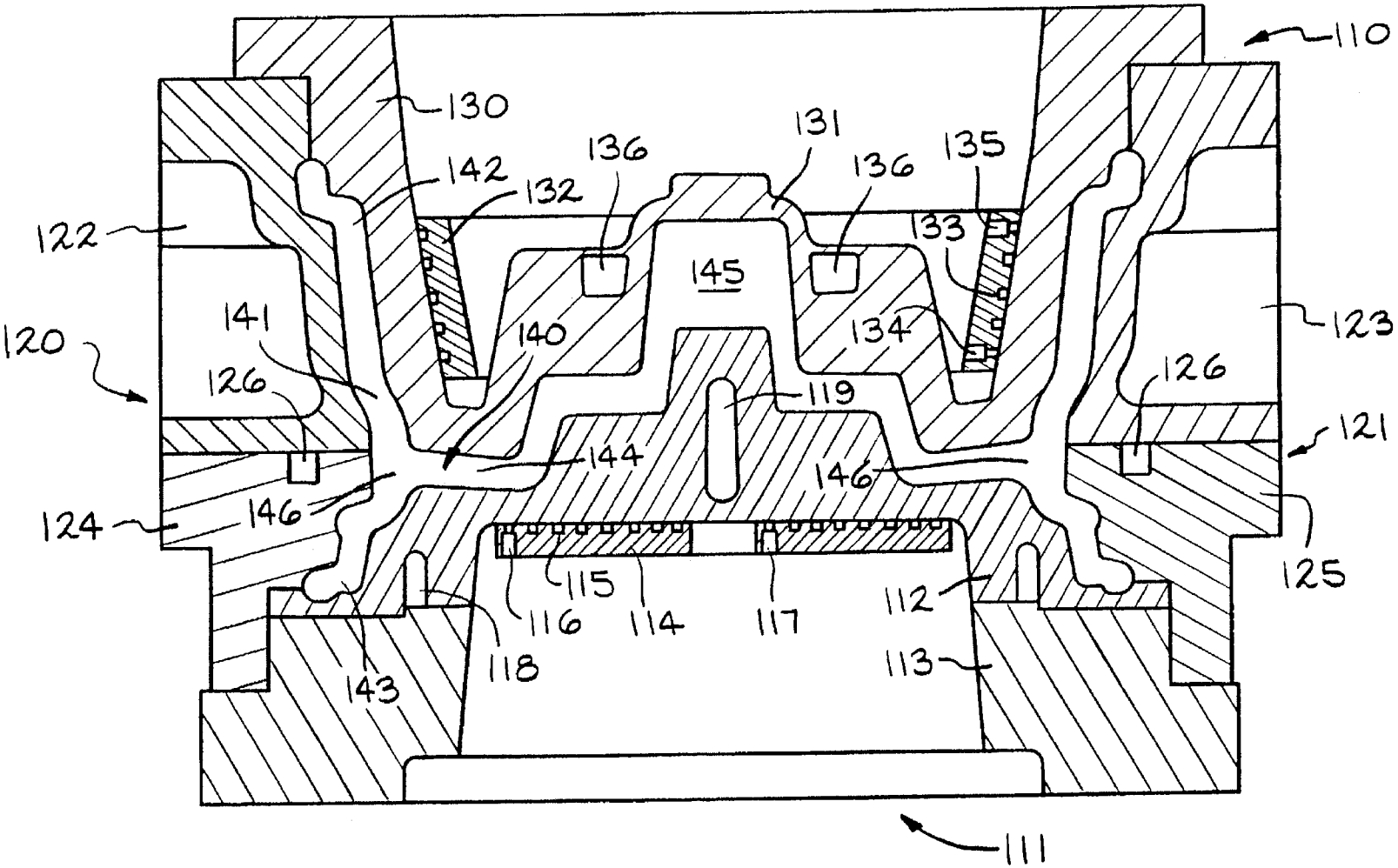
FIG. 7 is a sectional view of an improved mold assembly in accordance with the present invention which is used to cast a low offset wheel.

It is to be appreciated that the invention also can be practiced on low offset wheels (not shown) in which the wheel disc is axially recessed within the wheel rim. A simplified sectional view of an improved multi-piece mold assembly 110 for casting a low offset wheel is shown in FIG. 7. The improved mold assembly 110 includes a base member 111 which supports the other pieces of the mold assembly 110. The base member 111 has a generally disk-shaped upper portion 112 mounted upon a ring shaped lower portion 113. A disk-shaped base cooling block 114 formed of a metal having a high heat conductivity is attached to the bottom surface of the base member upper portion 112. The base cooling block 114 includes a spiral passageway 115 formed therein for conducting a cooling medium. The passageway 115 includes an inlet port 116 formed near the perimeter of the cooling block 114 and an outlet port 117 formed near the center of the block 114. The base upper portion 112 further includes a circumferential ring-shaped internal cooling passageway 118 formed therein adjacent to the base lower portion 113. The base upper portion 112 also includes an axial internal cooling passageway 119 formed therein extending into the center of the base member upper portion 112.

Two or more retractable side members 120 and 121 are carried by the base member 111. Similar to the base member 111, the side members 120 and 121 include upper portions 122 and 123 and lower portions 124 and 125. A ring-shaped passageway 126 is formed in the lower side portions 124 and 125 adjacent to the upper side portions 122 and 123. As will be described below, the passageway 126 is located adjacent to the portion of the mold 110 which forms the juncture of the wheel disc and wheel rim. The passageway 126 carries a cooling medium, as was described above.

A removable cup-shaped top member 130 having a cylindrical center portion 131 is disposed within the side members 120 and 121. An inner cooling block 132 having an inverted frustum shape is attached to the lower portion of the inner surface of the top member 130. The inner cooling block 132 is formed from a metal having a high heat conductivity and includes a passageway 133 formed therein for conducting a cooling medium. The passageway 133 can be formed in a spiral shape from the bottom to the top of the inner cooling block 132. An inlet port 134 formed near the bottom of the cooling block 132 receives a cooling medium and an outlet port 135 formed near the top of the cooling block 132 discharges the cooling medium. Alternately, the cooling passageway 133 can be formed as a plurality of parallel vertical passageways (not shown). The top member 130 further has a ring-shaped internal cooling passageway 136 formed within the cylindrical center portion 131.

The assembled mold members 111, 120, 121 and 130 define a mold cavity 140 which includes an annular rim cavity 141 having inner and outer flange cavities 142 and 143 and a disc cavity 144 having a central hub cavity 145. The disc cavity 144 is axially recessed relative to the outer end of the rim cavity 141 to provide the desired amount of offset of the wheel disc within the wheel rim. Similar to the improved mold assembly 80 show in FIG. 6, a large disc edge cavity 146 is formed where the disc cavity 144 joins the rim cavity 141. Accordingly, the circular side mold cooling passageway 126 is located adjacent to the disc edge cavity 146.

To form a wheel casting with the improved mold 110, molten metal is introduced into the mold cavity 140. Forced cooling is applied to the mold assembly 110 by circulating a cooling medium through the side cooling passageway 126. This forced cooling rapidly cools the molten metal in the disc edge cavity 146 adjacent to the passageway 126, causing solidification of the molten metal forming the wheel casting to begin at the juncture of the wheel disc and the wheel rim. The solidification of the molten metal then continues concurrently in three directions. The solidification proceeds axially upward in FIG. 7 across the rim cavity 141 from the disc edge cavity 146 towards the inner flange cavity 142. At the same time, solidification proceeds radially inwardly across the wheel disc cavity 144 from the disc edge cavity 146 towards the hub cavity 145. Finally, the solidification proceeds axially downward in FIG. 7 across the rim cavity 141 from the disc edge cavity 146 towards the outer flange cavity 143.

As described above, additional forced cooling can be applied to the mold assembly 110 by circulating a cooling medium through the base member cooling block 114 and internal passageways 118 and 119. Furthermore, cooling medium can be circulated through the top member cooling block 132 and internal cooling passageway 136.

Figure 8:
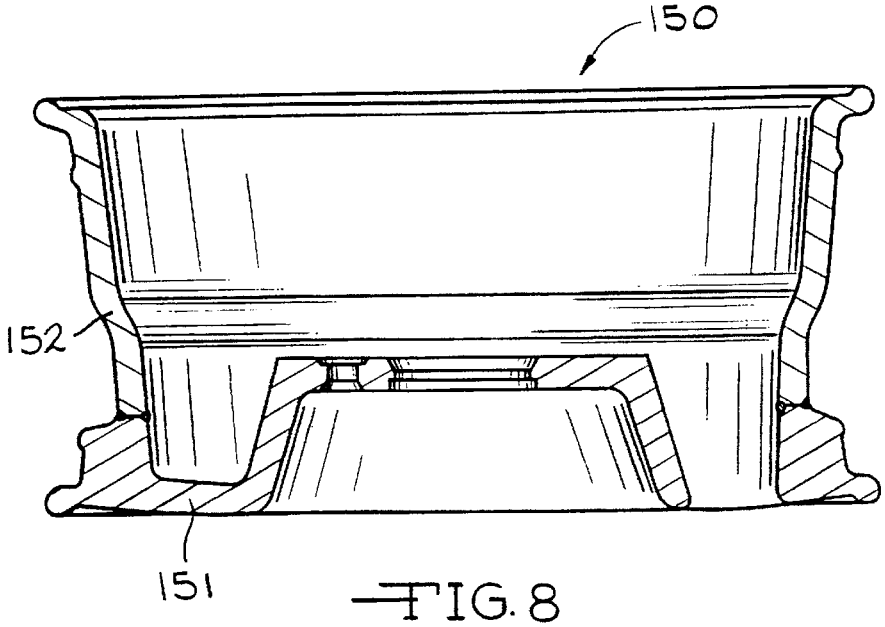
FIG. 8 is a sectional view of a cast full face modular wheel having a cast wheel disc attached to a separately formed partial wheel rim.
Figure 9:
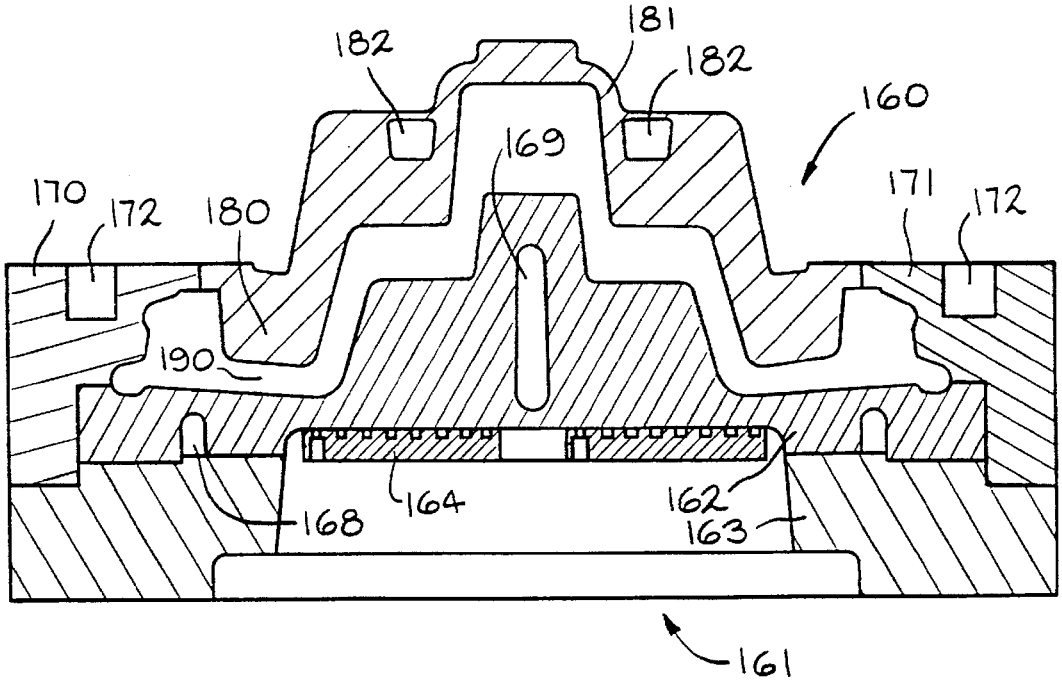
FIG. 9 is a sectional view of an improved mold assembly in accordance with the present invention which is used to cast the wheel disc shown in FIG. 8.

As explained above, the present invention is also applicable to a multi-piece wheel. One type of multi-piece wheel is a full face modular wheel 150 illustrated in a sectional view in FIG. 8 as having a circular cast wheel disc 151 attached to a conventionally formed partial wheel rim 152.

A simplified sectional view of an improved multi-piece mold assembly 160 for casting the wheel disc 151 is shown in FIG. 7. The improved mold assembly 160 includes a base member 161 which supports the other pieces of the mold assembly 160. The base member 161 has a generally disk-shaped upper portion 162 mounted upon a ring shaped lower portion 163. Similar to the molds described above, a disk-shaped base cooling block 164 formed of a metal having a high heat conductivity is attached to the bottom surface of the base member upper portion 162. The base upper portion 162 further includes a circumferential ring-shaped internal cooling passageway 168 formed therein adjacent to the base lower portion 163. The base upper portion 162 also includes an axial internal cooling passageway 169 formed therein extending into the center of the base member upper portion 162.

Two or more retractable side members 170 and 171 are carried by the base member 161. A ring-shaped passageway 172 which carries a cooling medium is formed in the upper portion of the side portions 170 and 171. A removable cup-shaped top member 180 having a cylindrical center portion 181 is disposed within the side members 170 and 171. The top member 180 includes a ring-shaped internal cooling passageway 182 formed within the cylindrical center portion 181.

The assembled mold members 161, 170, 171, and 180 define a mold cavity 190 for casting the wheel disc 151. To cast a wheel disc 151 with the improved mold 160, molten metal is introduced into the mold cavity 190. Forced cooling is applied to the mold assembly 160 by circulating a cooling medium through the side cooling passageway 172. As described above, the forced cooling rapidly cools the molten metal in the mold cavity adjacent to the passageway 172. This causes solidification of the molten metal forming the wheel casting to begin at the outer circumference of the wheel disc. The solidification of the molten metal then continues radially inwardly across the wheel disc cavity 190 toward the hub.

As described above, additional forced cooling can be applied to the mold assembly 110 by circulating a cooling medium through the base member cooling block 164 and internal passageways 168 and 169. Furthermore, cooling medium can be circulated through the top member internal cooling passageway 182.

Figure 10:
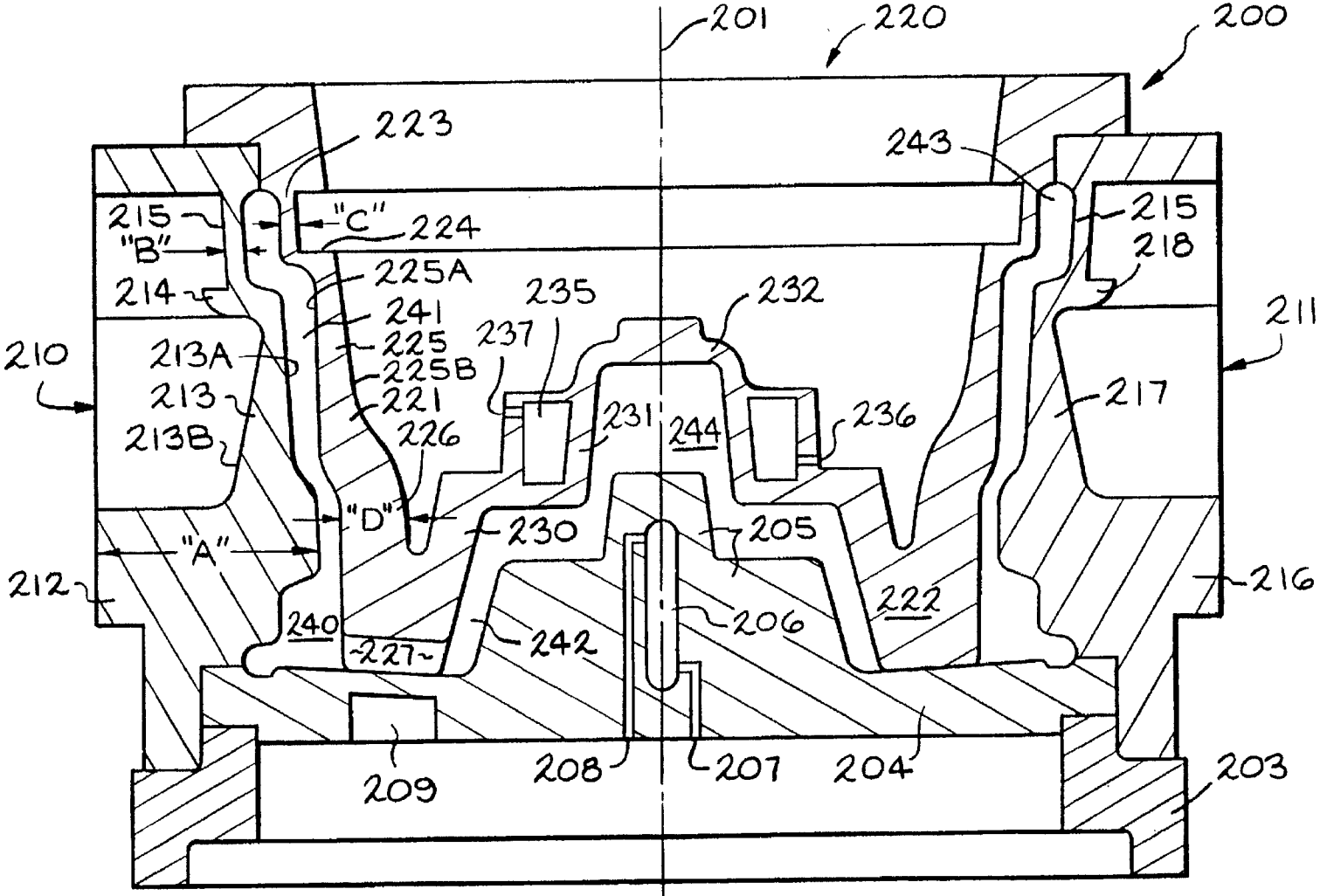
FIG. 10 is a sectional view of an alternate embodiment of an improved wheel mold in accordance with the present invention.

A simplified sectional view of an alternate embodiment of an improved multi-piece wheel mold 200 in accordance with the present invention is shown in FIG. 10. The mold 200 has a central axis 201 and is formed from a high temperature resistant material which is heat conductive, such as cast iron or high carbon steel The mold 200 includes a fixed base 202. The base 202 has a spacer ring 203 which carries a generally disc-shaped base member 204. The base member 204 includes a plurality of stepped cylindrical cores 205 which extend axially upward in FIG. 10 and are concentric with the axis 201. The cores 205 form the outboard surface of the wheel hub 59. An optional axial cooling passageway 206 is formed in the center of the cores 205. The cooling passageway 206 communicates with inlet and outlet passageways, 207 and 208, respectively, which are formed through the base member 204. A cooling medium, such as liquid, a mist or a pressurized gas, can be supplied to the cooling passageway 206 through the inlet passageway 207 and discharged through the outlet passageway 208. A plurality of arcuate-shaped recesses 209 (one shown) are formed in the bottom surface of the base member 204. The purpose for the recesses 209 will be explained below. The recesses 209 are equally spaced about the circumference of a circle which is concentric with the axis 201. Alternately, a continuous circular recess (not shown) can be formed in the bottom surface of the base member 204.

Two or more arcuate-shaped side members 210 and 211 are carried by the base 202. The side members 210 and 211 are moveable between an open position and a closed position by a conventional mechanism (not shown). The left side member 210 includes an arcuate-shaped lower portion 212, as shown in FIG. 10, which contacts the base member 204 when the side member 210 is in the closed position. The width of the lower portion 212, which is measured along a radius extending perpendicularly from the axis 201 and is identified by the letter "A" in FIG. 10, is relatively large. Accordingly, the lower portion 212 of the left side member 210 includes a large mass of metal.

A tapered wall 213 extends axially from the lower portion 212 of the side member 210. The wall 213 includes an inner surface 213A which forms a portion of the mold cavity and an outer surface 213B which opposite from the inner surface 213A. In the preferred embodiment illustrated in FIG. 10, each of the inner and outer wall surfaces 213A and 213B are tapered towards the other. However, it will be appreciated that the invention can be practiced with only one of the wall surfaces tapered. The taper is formed with the wall width increasing from top to bottom in FIG. 10.

The side segment wall 213 terminates in an arcuate-shaped upper portion 214. An arcuate-shaped recess 215 is formed in the outer surface of the upper portion 214 adjacent to a rim riser cavity. The purpose for the recess 215 will be described below. The width of the upper portion 214, which is measured along a radius extending perpendicularly from the axis 201 and is identified by the letter "B" in FIG. 10, is relatively small. Accordingly, the upper portion 214 includes a small mass of metal.

As shown in FIG. 10, the right side member 211 includes a lower portion, a wall and a upper portion which have similar shapes to corresponding portions of the left side member 210 and are identified by the numerical designators 216, 217 and 218, respectively. The arcuate-shaped recess 215 also extends across the outer surface of the upper portion 218 of the right side member 211. In the preferred embodiment, the recess 215 extends completely around the side members to form a continuous groove.

A top member 220 is disposed within the side members 210 and 211. The top member 220 is axially moveable between an open position and a closed position by a conventional mechanism (not shown). The top member 220 includes an annular side portion 221 and a bottom portion 222 having an inverted cup shape.

The top member side portion 221 includes an annular upper portion 223. An annular recess 224 is formed in the inside surface of the upper portion 223 adjacent to a rim riser cavity. The width of the upper portion 223, which is measured along a radius extending perpendicularly from the axis 201 and identified by the letter "C" in FIG. 10, is relatively small. Accordingly, the upper portion 223 includes a small mass of metal.

Similar to the side elements 210 and 211, a tapered wall 225 extends axially from the upper portion 223 of the top member 220. The wall 225 includes an outer surface 225A which forms a portion of the mold cavity and an inner surface 225B which opposite from the inner surface 225A. In the preferred embodiment illustrated in FIG. 10, each of the inner and outer wall surfaces 225A and 225B are tapered toward the other. However, it will be appreciated that the invention can be practiced with only one of these surfaces tapered. The taper is formed with the wall width increasing from top to bottom in FIG. 10.

The wall 225 terminates in an annular lower portion 226. The width of the lower portion 226, which is measured along a radius extending perpendicularly form the axis 210 and is identified by the letter "D" in FIG. 10, is relatively large. Accordingly, the lower portion 226 of the top member side portion 221 includes a large mass of metal.

The bottom portion 222 of the top member 220 contacts the top of the bottom member 202 when the top member 220 is in the closed position. A plurality of radial groves 227 (one shown) extend across the bottom portion 222. These radial grooves 227 are used to cast spokes in the wheel 50. A plurality of stepped rings which include a bottom ring 230, a center ring 231 and a top ring 232 extend in an upward direction in FIG. 10 from the bottom portion 222. An optional annular cooling passageway 235 is formed in the center ring 231. The cooling passageway 235 communicates with inlet and outlet passageways, 236 and 237, respectively, which also are formed in the center stepped ring 231. A cooling medium, such as a liquid, a mist or a pressurized gas, can be supplied to the cooling passageway 235 through the inlet passageway 236 and discharged through the outlet passageway 233.

The assembled mold members 202, 210, 211 and 220 form a mold cavity 240 for casting the wheel 50. The mold cavity 240 includes an annular wheel rim cavity 241 for casting the wheel rim portion 51 and a wheel disc cavity 242 for casting the wheel disc 58 of the wheel 50. Because the walls 213 and 217 of the side members 210 and 211 and the wall 225 of the top member side portion 221 are tapered, the rim cavity 241 also is tapered. However, the taper of the rim cavity 241 is reversed from the taper of the side and top members with the upper portion of the cavity, as shown in FIG. 10, being wider than the lower portion of the cavity. Thus, the narrowest portion of the wheel rim cavity 241 is adjacent to the widest portion of the side members 210 and 211 and the top member 220 and the widest portion of the wheel rim cavity 241 is adjacent to the narrowest portion of the side members 210 and 211 and the top member 220. The upper end of the rim cavity 241 terminates in a rim riser cavity 243. As described above, the rim riser cavity is between the recess 215 formed in the side members 210 and 211 and the recess 224 formed in the top member 220. A ball riser cavity 244 extends axially from the center of the disc cavity 242. The ball riser cavity 244 is surrounded by the optional center ring cooling passageway 235.

The process of casting the wheel 50 with the mold assembly 200 will now be described. Molten metal is introduced into the mold cavity 240 by conventional means, such as gravity feed or low pressure injection, through a gate (not shown). The molten metal fills the mold cavity 240 and the rim and ball riser cavities 243 and 244. The mold members 202, 210, 211 and 220 conduct heat from the molten metal, causing the metal to begin to solidify.

The maximum conduction of heat from the molten metal occurs where the mold 200 has the greatest metal mass. This includes the lower portions 212 and 216 of the side members 210 and 211 and the lower portion 226 of the top member side portion 221 which are adjacent to the narrowest portion of the wheel rim cavity 241. The air surrounding the mold 200 functions as insulation. The recesses 215 and 224 formed in the upper portions 214, 218 and 223 of the side members 210 and 211 and the top member side portion 221 bring the insulating air closer to the rim riser cavity 243, slowing the cooling of the molten metal contained therein. Thus, heat is absorbed more rapidly in the massive lower portions 212, 216 and 226 of the side members 210 and 211 and the top member 220 than in the narrow upper portions 214, 215 and 223 of the same mold members. Therefore, the molten metal begins to solidify in the lower portion of the wheel rim cavity 241. The solidification of the molten metal then continues simultaneously in two directions, in an upward axial direction across the wheel rim cavity 241 and in an inward radial direction across the wheel disc cavity 242.

As described above, the metal contracts as it solidifies. As the metal contracts, additional molten metal flows from the rim riser and ball riser cavities 243 and 244 to assure that the mold cavity 240 remains fully filled. The taper of the wheel rim cavity 241 enhances the flow of molten metal into the mold cavity 240 from the wheel rim riser cavity 243. The arcuate-shaped recesses 209 formed in the bottom surface of the base member 204 function to retard the cooling of the molten metal contained in the radial grooves 227 which form the wheel spokes. This allows molten metal to flow from the ball riser cavity 244 across the wheel disc cavity 242, through the radial grooves 227 and into the portion of the mold cavity 240 which forms the wheel sidewall 54A.

The center ring and base member cooling passageways 235 and 206 initially contain air, which functions to slow cooling of the molten metal contained in the ball riser cavity 244. After a predetermined period of time has elapsed, a cooling medium can be circulated through the cooling passages 206 and 235 to provide supplemental cooling to accelerate the solidification of the molten metal in the ball riser cavity. Once the metal has cooled sufficiently, the top and side members 220, 210 and 211 are retracted and the wheel casting is removed from the mold 200.

It will be appreciated that, while the preferred embodiment has been described utilizing supplemental cooling, the invention can be practiced without any supplemental cooling. Accordingly, bi-directional cooling is provided solely by the structure of the mold members. When supplemental cooling is omitted, the cooling passageways 206 and 235 are retained function as insulating voids to retard cooling of the molten metal contained in the ball riser cavity 244. Alternately, the center of the top member bottom portion 222 may be formed with a thinner cross section to reduce the mass thereof (not shown).

Figure 11:
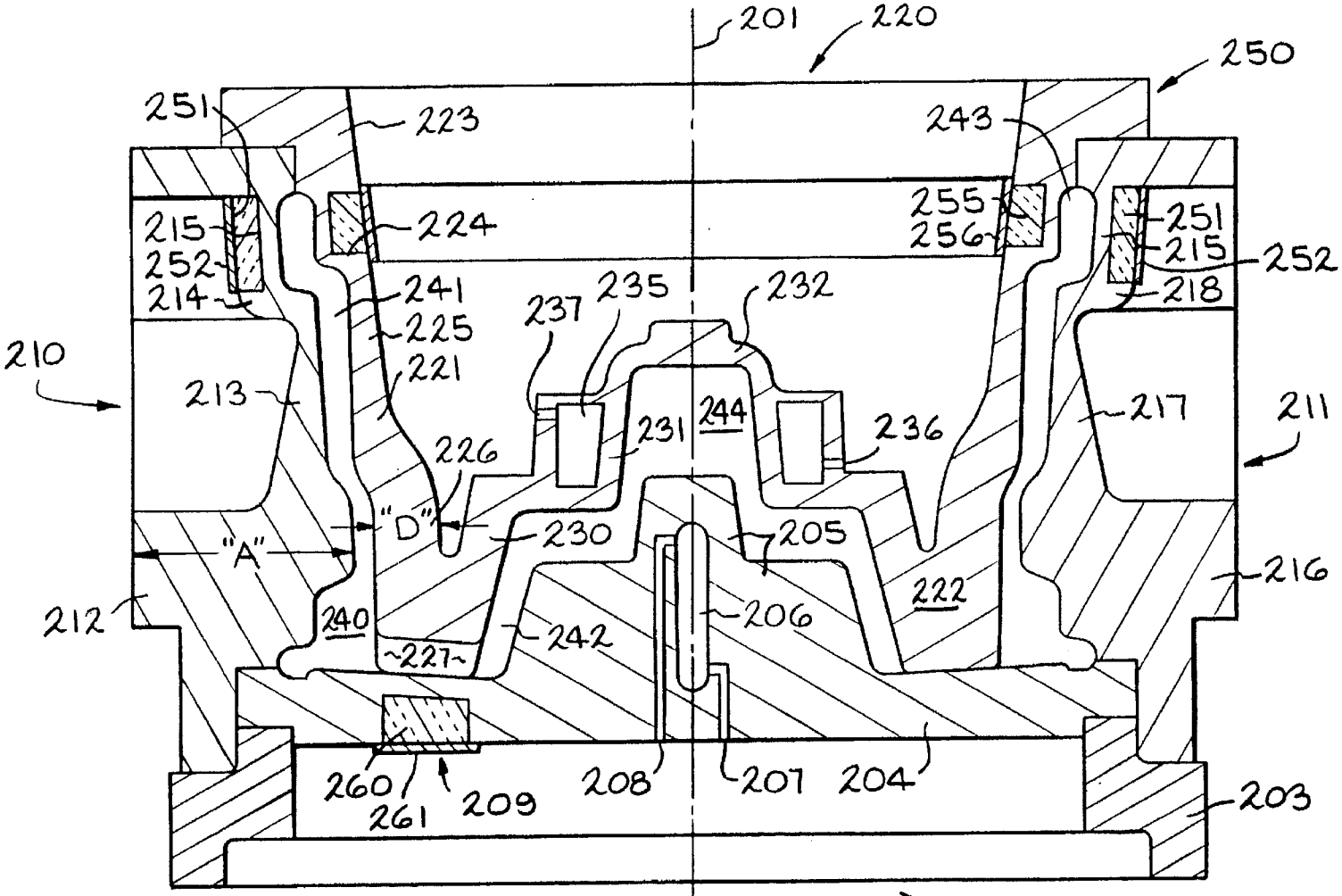
FIG. 11 is a sectional view of the wheel mold shown in FIG. 10 which includes supplemental insulation.

An alternate embodiment 250 of the mold 200 is shown in FIG. 11. Components of the mold 250 which are the same as components of the mold 200 shown in FIG. 10 are identified with the same numerical designators. As shown in FIG. 11, the recess 215 in the upper portions 214 and 218 of the side members 210 and 211 receives an insert 251 formed from an insulative material, such as K-wool. The insert 251 is secured in position by a retaining ring 252 which covers the recess 215. Similarly, the recess 224 in the upper portion 223 of the top member 220 receives an insert 255 formed from an insulative material, such as K-wool. The insert 255 is secured in position by a retaining ring 256 which covers the recess 224. Additionally, the arcuate shaped recesses 209 formed in the bottom surface of the base member 204 receive an insert 260 formed from an insulative material, such as K-wool. Each of the inserts 260 is secured in position by an arcuate-shaped retaining plate 261 (one shown) which covers the corresponding recess 260.

The inserts 251, 255 and 260 further reduce heat transfer from the corresponding adjacent portions of the mold members 210, 211, 220 and 204 by eliminating convection air currents in the recesses 215, 224 and 209. It will be appreciated that, while all the recesses 215, 224 and 209 are illustrated as receiving insulative inserts, the invention can be practiced by placing inserts in only selected ones of the recesses. Alternately, the invention can be practiced without the inserts 251, 155 and 260, but with the retaining rings 252 and 256 and the plates 261 covering the corresponding recesses 215, 224 and 209 to restrict the convection air currents contained therein.

Figure 12:
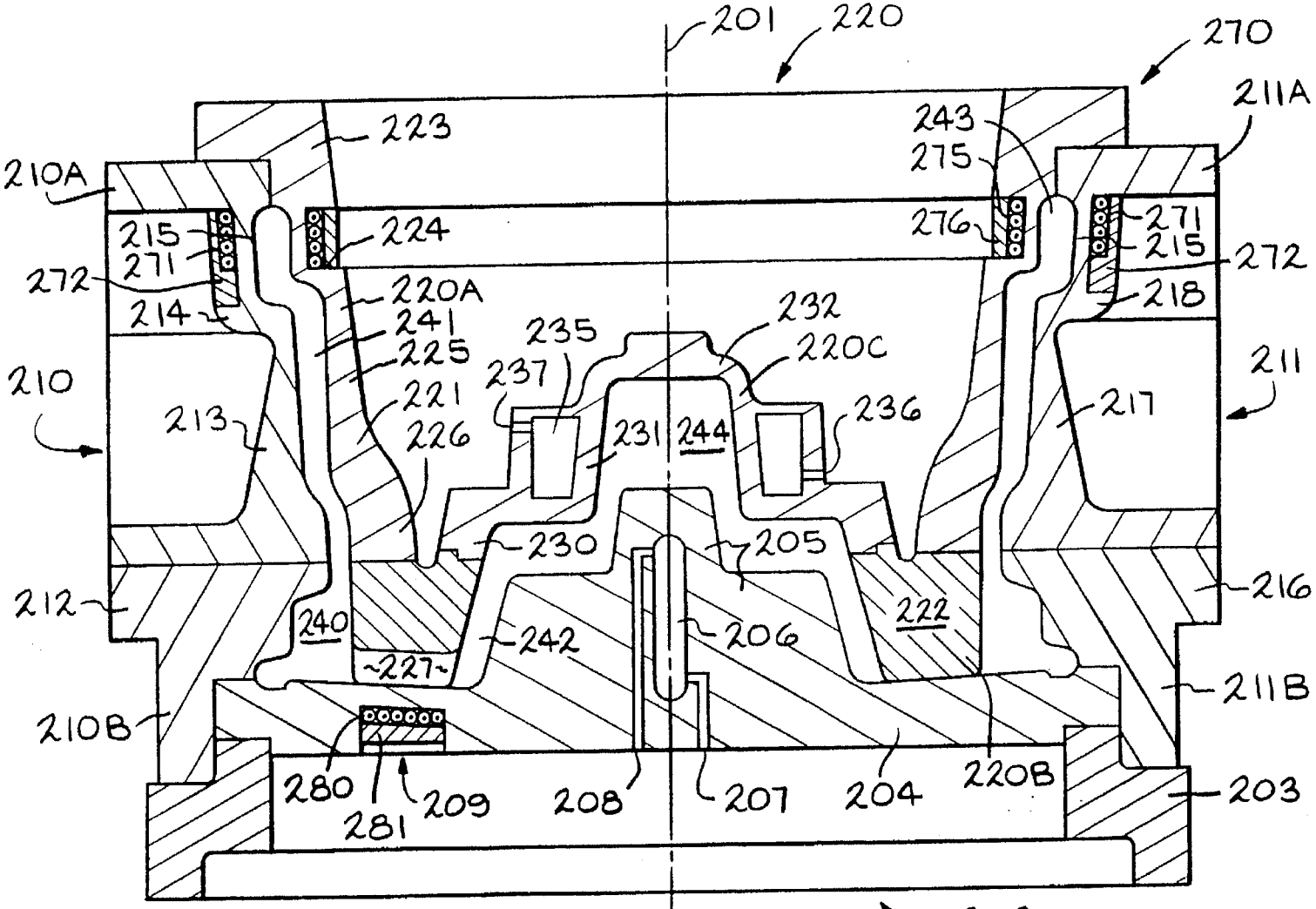
FIG. 12 is a sectional view of the wheel mold shown in FIG. 10 which includes supplemental heaters.

Another alternate embodiment 270 of the wheel mold is shown in FIG. 12. Components of the mold 270 which are the same as components of the mold 200 shown in FIG. 10 are identified with the same numerical designators. As shown in FIG. 12, a supplemental means for heating a portion of the mold 271, such as electric resistance or induction heating elements, is disposed in the recess 215 in the upper portions 214 and 218 of the side members 210 and 211. The heating means 271 is secured by a retaining ring 272 which is disposed in the recess 215. Similarly, a supplemental heating means 275, such as electric resistance or induction heating elements, is disposed in the recess 224 in the upper portion 223 of the top member 220. The heating means 275 is secured by a retaining ring 276 which is disposed in the recess 224. Additionally, a supplemental heating means 280, such as electric resistance or induction heating elements, is disposed in each of the arcuate shaped recesses 209 formed in the bottom surface of the base member 204. Each of the heating means 280 is secured by an arcuate-shaped retainer plate 281 (one shown) which covers the corresponding recess 260.

The supplemental heating means 271, 275 and 280 are operable to further reduce heat conduction within adjacent portions of the mold members 210, 211, 220 and 204 by adding heat thereto. It will be appreciated that, while the preferred embodiment is illustrated as having heating means included in all the recesses 215, 224 and 209, the invention can be practiced with heating means in only selected ones of the recesses.

As also shown in FIG. 12, the side members 210 and 211 include upper sections 210A and 211A and lower sections 210B and 211B. The upper sections 210A and 211A are formed from a first material having a first conductivity of heat transfer while the lower sections 210B and 211B are formed from a second material having a second conductivity of heat transfer which is greater than the first conductivity of heat transfer. For example, the upper sections 210A and 211A could be formed from a carbon steel, such as H13 steel, while the lower sections 210B and 211B could be formed from cast iron. Similarly, the top member 220 includes an upper section 220A, an intermediate section 220B and a center section 220C. The upper and center sections 220A and 220C are formed from the first material while the intermediate section 220B is formed from the second material. The use of different materials having different conductivities of heat transfer increases the rate of heat transfer through the lower sections 210B and 211B of the side members 210 and 211 and the intermediate section 220B of the top member 220. This further accelerates the solidification of the molten metal in the lower portion of the wheel rim cavity 241. The solidification of the molten metal then continues simultaneously in two directions, as described above.

It will be appreciated that, while the preferred embodiment of the invention illustrated in FIG. 12 includes supplemental heating means 271, 275 and 280 and side and top members formed from different materials, the invention can be practiced with only supplemental heating means. Alternately, the invention can be practiced with only side and top members formed from two materials. Additionally, the metals forming the sections of the top member 220 can be different from the metals which form the side members 210 and 211. However, the metal forming the intermediate section 220B of the top member 220 is selected to have a greater conductivity of heat transfer than that of the metal forming the upper and center sections 220A and 220C thereof.

Figure 13:
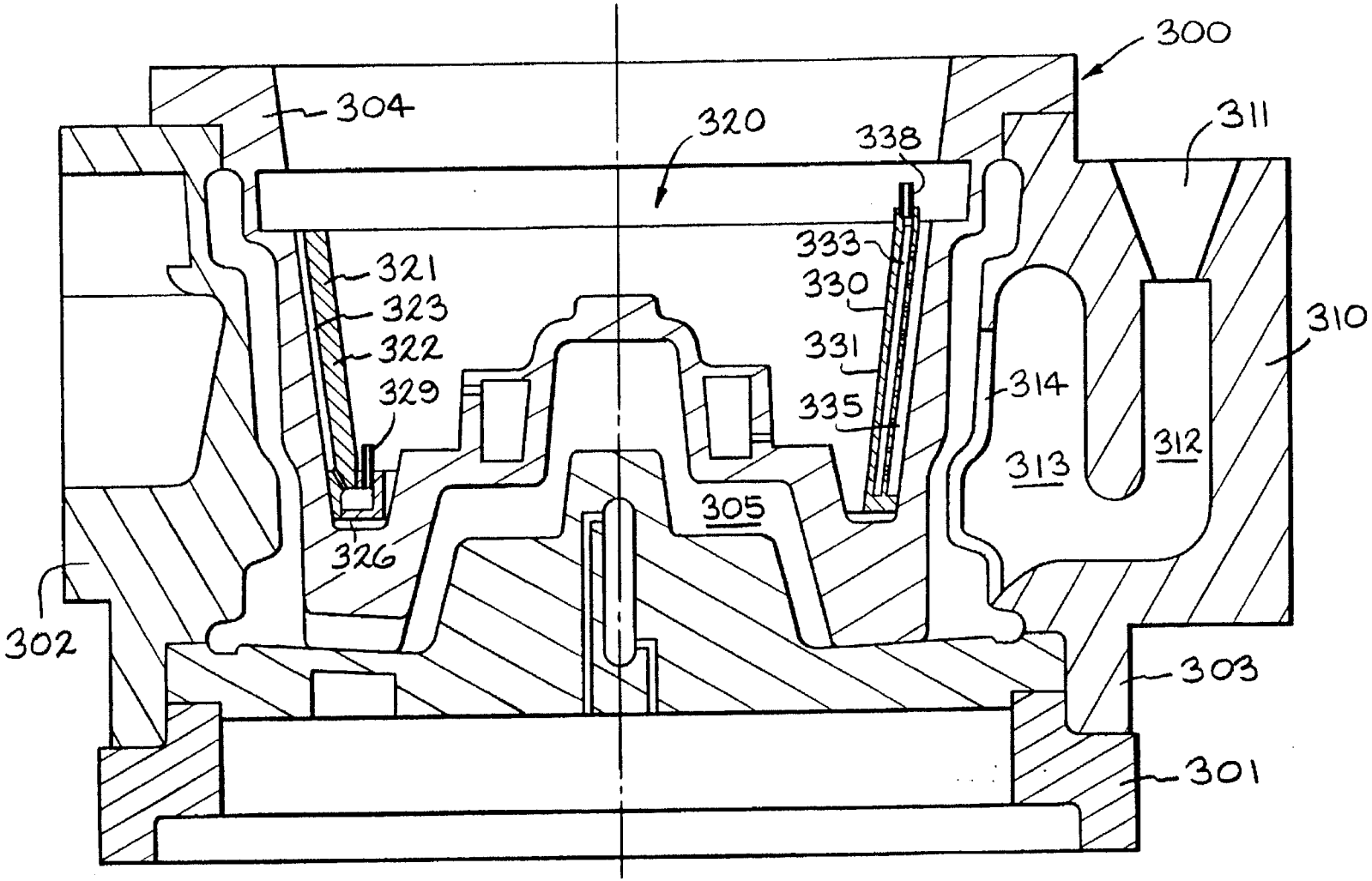
FIG. 13 is a sectional view of another alternate embodiment of an improved wheel mold in accordance with the present invention.

An alternate embodiment of the mold is shown generally at 300 in FIG. 13. Similar to the molds described above, the mold 300 includes a base member 301 which carries left and right side members, 302 and 303, respectively. A top member 304 is received between the side members 302 and 303 to define a mold cavity 305. The shape of the top member wall has been simplified in FIG. 13, however, it will be appreciated that the invention can be practiced with the top member wall having the shape shown in FIGS. 7 and 10 through 12.

The right side member 303 includes a gate member 310 extending from the side thereof. The gate includes a funnel shaped inlet chamber 311. The inlet chamber 311 communicates through a gate passageway 312 with an intermediate chamber 313 formed within the gate member 310. A narrow axial opening 314 which communicates with the mold cavity 305 is formed through the inner wall of the intermediate chamber 313.

During a casting operation, molten metal is poured into the inlet chamber 311 and flows through the gate passageway 312 to fill the intermediate chamber 313. The molten metal flows through the opening 314 to fill the mold cavity 305. The axial orientation of the opening 314 feeds molten metal across the rim portion of the mold cavity 305 to rapidly fill the cavity 305.

Figure 14:
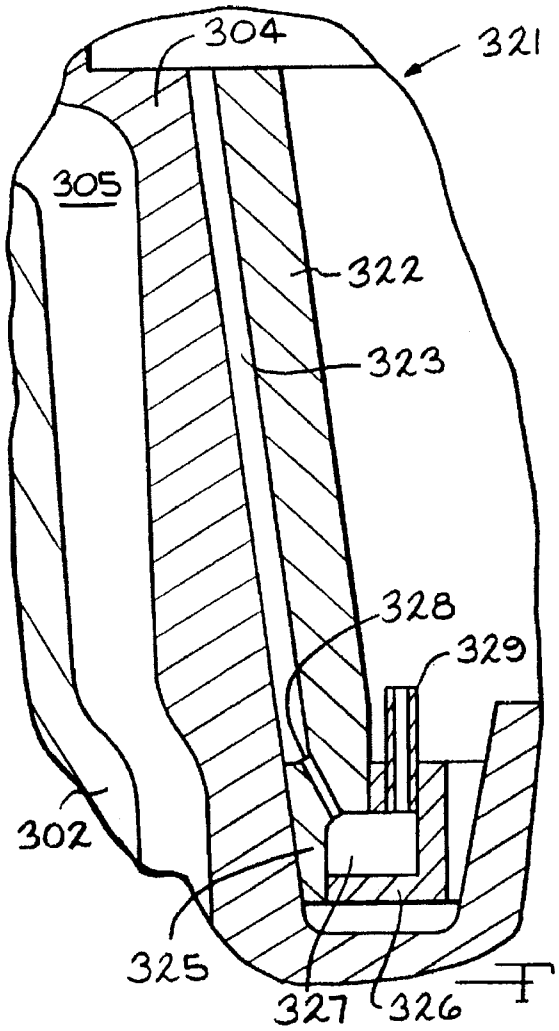
FIG. 14 is an enlarged fragmentary sectional view of a portion of the wheel mold shown in FIG. 13.

The mold 300 also includes a first supplemental cooling apparatus 320 mounted inside the top member 304. The cooling apparatus 320 includes an arcuate-shaped wall 322 extending parallel to the entire inner surface of the top member 304 except for the portion of the top member which is adjacent to the gate member 310. In the preferred embodiment, the wall 322 extends around 340° of the circumference of the inner surface. As best seen in FIG. 14, the wall 322 is spaced apart from the inner surface of the top member 304 to define a cooling chamber 323. In the preferred embodiment, the gap between the wall 322 and the top member 304 is approximately one sixteenth of an inch (1.6 mm). The top of the cooling chamber 323 is open to the atmosphere. The ends of the wall 322 extend radially into contact with the inner surface of the top member 304 (not shown).

A collar 325 extends radially towards the top member 304 from the bottom of the wall 322. The collar 325 engages the inner surface of the top member 304 and supports the wall 322 within the top member 304. An arcuate U-shaped member 326 is attached to the bottom of the wall 322 to form a plenum 327. As will be explained below, the plenum receives a pressurized cooling medium which, in the preferred embodiment, is compressed air. A plurality of openings 328 (one shown) extend through the collar 323 between the plenum 327 and the cooling chamber 323. The openings 328 are spaced equally along the circumference of the plenum 327 to assure a uniform distribution of the cooling medium from the plenum 327 into the cooling chamber 323. A first nipple 329 is attached to the U-shaped member 326 and communicates with the plenum 327. The first nipple 329 is connected to a source (not shown) of the pressurized cooling medium.

Figure 15:
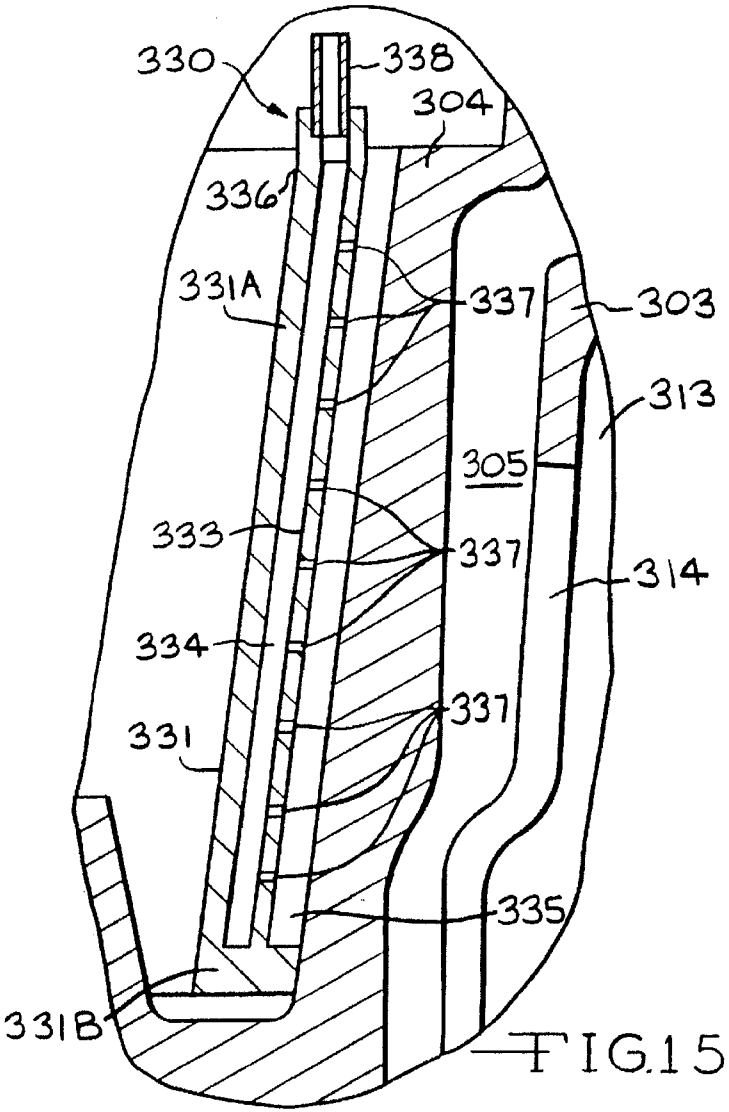
FIG. 15 is an enlarged fragmentary sectional view of another portion of the wheel mold shown in FIG. 13.

The mold 300 also includes a second supplemental cooling apparatus 330 mounted on the inside of the portion of the top mold member 304 which is adjacent to the gate member 310. In the preferred embodiment, the second supplemental cooling apparatus 330 extends between the ends of the first supplemental cooling apparatus 320 and covers the remaining 20° circumference of the inner surface of the top member 304. The second cooling apparatus 330 includes an L-shaped member 331 having a wall portion 331A extending parallel to the inner surface of the top member 320 and a base portion 331B extending radially towards the top member 304. The base portion 331B engages the inner surface of the top member 304 and supports the L-shaped member 331 within the top member 304. As best seen in FIG. 15, the wall portion 331A of the L-shaped member 331 is spaced apart from the inner surface of the top member 304 to define a chamber. A partition 333 divides the chamber into a plenum 334 and a cooling chamber 335. An arcuate-shaped member 336 is disposed between the top of the L-shaped member 331 and the partition 333 to close the top of the plenum 334. The cooling chamber 335, which is adjacent to the inner surface of the top member 304, is open at the top. A plurality of holes 337 are formed through the partition 333. The holes 337 are formed in parallel rows, one of which is shown in FIG. 15, which extend axially across the partition 333. A second nipple 338 is attached to the arcuate-shaped member 337 and communicates with the plenum 324. The second nipple 338 is connected to a source (not shown) of a pressurized cooling medium which, in the preferred embodiment, is compressed air.

During casting operations, molten metal is poured into the mold cavity 305 through the gate passageways. A pressurized cooling medium is applied to the first nipple 329. The cooling medium pressurizes the plenum 327 in the first supplemental cooling apparatus 320. The cooling medium flows through the openings 328 and into the cooling chamber 323. Because the top of the cooling chamber 323 is open to the atmosphere, the cooling medium flows across the inner surface of the top member 304 and escapes into the atmosphere. As the cooling medium flows across the top member 304, the cooling medium removes heat radiated therefrom. As heat is removed, the cooling medium is warmed and becomes less effective for heat removal. Accordingly, the cooling medium establishes a temperature gradient which extends axially along the inner surface of the top member 304 and has its lowest temperature at the bottom of the cooling chamber 323. This temperature gradient enhances solidification of the molten metal within the rim portion of the mold cavity 305 in an axial direction, as described above.

A pressurized cooling medium also is applied to the second nipple 338. The cooling medium pressurizes the plenum 334 in the second supplemental cooling apparatus 330 of the cooling means 320. In the preferred embodiment, the cooling medium is applied to the second cooling apparatus 330 simultaneously with the application of the cooling medium to the first cooling apparatus 320. Alternately, the application of the cooling medium to the second nipple 338 could be delayed by a predetermined time period. The cooling medium flows through the openings 337 in the partition 333 and into the cooling chamber 335. Because the top of the cooling chamber 335 is open to the atmosphere, the cooling medium flows across the inner surface of the top member 304 and escapes to the atmosphere. As the cooling medium flows across the top member 304, the cooling medium removes heat radiated from the top member 304. The portion of the top core 304 being cooled by the second supplemental cooling apparatus 330 is adjacent to the gate opening 314 and is subjected to molten metal which is entering the mold cavity 305 and thus has the highest temperature. Accordingly, the plurality of holes 337 formed through the partition 333 assure that the cooling medium is uniformly applied to the surface of the top member 304 for optimum cooling thereof.

While the preferred embodiment has been described as using compressed air as a cooling medium, other cooling mediums can be used. For instance, other compressed gases can be used to cool the top member 304. Additionally a mist of a gas and liquid can be supplied to the supplemental cooling apparatus 320 and 330. A liquid coolant also can be used, however, collection means (not shown) would have to be added to the supplemental cooling apparatus 320 and 330.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. For example, the supplemental cooling apparatus described above can be included in the wheel molds 80, 110, 200, 250 and 270 shown in FIGS. 6, 7 and 10 through 12.

What is claimed is:

1. A mold for casting a vehicle wheel comprising:

a base member;

a top member; and a plurality of arcuate-shaped side members, said base, top and side members cooperating to define a mold cavity for casting a vehicle wheel and at least one of said side and top members including a tapered wall portion such that molten metal adjacent to the wider portion of said tapered wall solidifies before molten metal adjacent to the narrower portion of said tapered wall.

2. A mold according to claim 1 wherein said mold cavity includes a rim cavity portion and a disc cavity portion and further wherein the wide portion of said taper wall is adjacent to a junction of said rim cavity and said disc cavity and further wherein said tapered wall causes molten metal in said cavity to begin to solidify in said junction between said rim and disc cavities with solidification continuing simultaneously axially across said rim cavity and radially across said disc cavity.

3. A mold according to claim 2 wherein said tapered wall portion includes a first surface which defines a surface of said rim cavity and a second surface opposite from said first surface and further wherein at least one of said first and second surfaces is tapered.

4. A mold according to claim 3 wherein both of said first and second surfaces are tapered.

5. A mold according to claim 3 wherein the width of said tapered wall portion decreases along an axial direction from a first end of said rim cavity which is adjacent to said junction between said rim and disc cavities to a second end of said rim cavity which is opposite from said first end.

6. A mold according to claim 5 wherein at least one of said side and top members includes a relatively large mass of metal adjoining said tapered wall at said first end of said mold cavity and a relatively small mass of metal adjoining said tapered wall at said second end of said mold cavity.

7. A mold according to claim 1 wherein at least one of said base, side, and top members includes a recess formed in a surface thereof which is opposite from said mold cavity.

8. A mold according to claim 7 wherein an insulating material is disposed within said recess.

9. A mold according to claim 7 wherein a heating apparatus is disposed within said recess.

10. A mold according to claim 1 wherein at least one of said side and top members includes a first component formed from a first material having a first coefficient of thermal conductivity and a second component formed from a second material which is adjacent to said first component and has a second coefficient of thermal conductivity, said first coefficient of thermal conductivity being less than said second coefficient of thermal conductivity.

11. A mold according to claim 10 wherein said mold cavity includes a rim cavity and a disc cavity and further wherein said second component is adjacent to the portion of said mold cavity which forms a junction of said rim and disc cavities.

12. A mold according to claim 11 wherein said first component is formed from a carbon steel and said second component is formed from cast iron.

13. A mold for casting a vehicle wheel comprising:

a base member;

a top member;

a plurality of arcuate-shaped side members, said base, top and side members cooperating to define a mold cavity for casting a vehicle wheel; and a cooling apparatus which includes an arcuate-shaped wall mounted inside said top member, said wall extending parallel to a portion of an inside surface of said top member and spaced apart therefrom to define a cooling chamber which extends axially along substantially the entire axial length of said inside surface of said top member, said cooling apparatus adapted to receive a cooling medium at a first axial end of said cooling chamber and discharge said cooling medium from a second axial end of said cooling chamber, said second axial end being opposite from said first axial end, said wall cooperating with said inside surface of said top member to direct said cooling medium to flow in a generally axial direction across substantially the entire axial length of said inside surface of said top member to establish an axially directed temperature gradient thereacross.

14. A mold according to claim 13 wherein said cooling chamber extends across a portion of the circumference of said inside surface of said top member, and further wherein said first end of said cooling chamber is closed to the atmosphere and said second end of said cooling chamber is open to the atmosphere.

15. A mold according to claim 13 wherein one of said side members includes a gate member for introducing molten metal into said mold cavity, and further wherein a supplemental cooling apparatus is mounted inside the portion of said top member which is adjacent to said gate member, said supplemental cooling apparatus including a wall extending parallel to an inside surface of said top member and spaced apart therefrom to define a second cooling chamber which extends axially along substantially the entire length of said inside surface of said top member, said supplemental cooling apparatus being adapted to receive a cooling medium in said second cooling chamber and to direct said cooling medium across said inside surface of said top member in an axial direction to cool said inside surface of said top member adjacent to said gate member.

16. A mold according to claim 13 wherein said supplemental cooling apparatus includes a partition disposed between said wall and said top member surface which divides said second cooling chamber to form a cooling chamber adjacent to said top member surface and a plenum for receiving said cooling medium, said partition having a plurality of holes formed therethrough.

17. A mold according to claim 13 further including a pressurized gas supply connected to said cooling apparatus and said supplemental cooling apparatus, said pressurized gas being said cooling medium.

* * * * *

UNITED STATES PATENT AND TRADEMARK OFFICE

CERTIFICATE OF CORRECTION

PATENT NO. : 5,647,426

DATED : July 15, 1997

INVENTOR(S) : Romulo A. Prieto, Daniel C. Wei and Bor-Liang Chen

It is certified that error appears in the above-indentified patent and that said Letters Patent is hereby corrected as shown below:

Column 20, Claim 16, Line 1, after "claim", change "13" to -- 15 --.

Column 20, Claim 17, Line 1, after "claim", change "13" to -- 15 --.

Signed and Sealed this

Seventh Day of October, 1997

*Attest:*

Bruce Lehman

BRUCE LEHMAN

*Attesting Officer*

*Commissioner of Patents and Trademarks*